US011850488B2

(12) United States Patent
Carullo

(10) Patent No.: US 11,850,488 B2
(45) **Date of Patent: *Dec. 26, 2023**

(54) BASEBALL BATTING MAT WITH FRONT FOOT RESTRAINT

(71) Applicant: Matthew Carullo, Oakton, VA (US)

(72) Inventor: Matthew Carullo, Oakton, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/984,970

(22) Filed: Nov. 10, 2022

(65) Prior Publication Data

US 2023/0277905 A1 Sep. 7, 2023

Related U.S. Application Data

(63) Continuation of application No. 17/207,731, filed on Mar. 21, 2021, now Pat. No. 11,504,592.

(60) Provisional application No. 62/992,940, filed on Mar. 21, 2020.

(51) Int. Cl.

| | |
|---|---|
| ***A63B 69/36*** | (2006.01) |
| ***A63B 69/00*** | (2006.01) |
| *A63B 102/32* | (2015.01) |
| *A63B 102/18* | (2015.01) |

(52) U.S. Cl.

CPC ..... *A63B 69/0002* (2013.01); *A63B 69/3661* (2013.01); *A63B 69/3667* (2013.01); *A63B 2069/0008* (2013.01); *A63B 2102/18* (2015.10); *A63B 2102/32* (2015.10)

(58) Field of Classification Search

CPC ..... A63B 69/0002; A63B 69/3661; A63B 69/3667; A63B 2069/0008; A63B 2102/18; A63B 2102/32

USPC ..... 473/217, 266, 270, 273, 422, 450, 464, 473/452, 458

See application file for complete search history.

(56) References Cited

U.S. PATENT DOCUMENTS

| | | | |
|---|---|---|---|
| 1,484,390 | A | 2/1924 | Gibbs et al. |
| 2,189,613 | A | 2/1940 | Paulsen |
| 2,777,697 | A | 1/1957 | Crossot |
| D199,247 | S | 9/1964 | Cordier |
| 3,350,096 | A | 10/1967 | Kile et al. |
| 3,363,903 | A | 1/1968 | O'Brien |
| 3,372,930 | A | 3/1968 | Sertich |
| 3,606,341 | A | 9/1971 | Honbarger |
| 3,979,116 | A | 9/1976 | Matchick |
| 4,101,130 | A | 7/1978 | Richards |
| 4,657,258 | A | 4/1987 | Melov et al. |

(Continued)

OTHER PUBLICATIONS amazon.com [online], "Baseball Softball and T-ball batter Stance Training Mat," Nov. 4, 2021, retrieved on Aug. 10, 2023, retrieved from URL<https://www.amazon.com/Baseball-Softball-Training-Perfect-Without/dp/B09LIL9VV8/>, 7 pages.

(Continued)

*Primary Examiner* — Nini F Legesse
(74) *Attorney, Agent, or Firm* — Fish & Richardson P.C.

(57) ABSTRACT

A sports training apparatus includes a flat mat having visible indicia adapted to indicate placement of at least one foot of a user of the apparatus, and a foot restraint adapted to hold a front foot of the user so that the front foot remains in contact with a top surface of the flat mat. The front foot is in an intended direction of a swing of a sports implement.

20 Claims, 6 Drawing Sheets

(56) References Cited

U.S. PATENT DOCUMENTS

| | | | | |
|---|---|---|---|---|
| 4,915,387 | A * | 4/1990 | Baxstrom | A63B 69/36 473/270 |
| 4,932,656 | A | 6/1990 | Pierce | |
| 5,062,643 | A | 11/1991 | Bibbey et al. | |
| 5,318,290 | A | 6/1994 | Sawyer | |
| D348,901 | S | 7/1994 | Mininno | |
| 5,330,176 | A | 7/1994 | Cagney, Jr. | |
| 5,536,004 | A | 7/1996 | Wiseman et al. | |
| 5,642,880 | A | 7/1997 | Wiseman et al. | |
| D399,280 | S | 10/1998 | Griffin | |
| 5,947,833 | A | 9/1999 | Alward | |
| 5,976,027 | A | 11/1999 | Kachmar | |
| D418,569 | S | 1/2000 | Murphy | |
| 6,077,169 | A | 6/2000 | Florian | |
| 6,386,996 | B1 | 5/2002 | Foster | |
| 6,432,001 | B1 | 8/2002 | Pierce | |
| D476,052 | S | 6/2003 | Barth et al. | |
| 6,638,176 | B1 | 10/2003 | Hayes et al. | |
| D498,792 | S | 11/2004 | Toniolo | |
| 6,955,616 | B1 * | 10/2005 | Barth | A63B 69/0062 482/79 |
| 6,988,966 | B1 | 1/2006 | Guzman | |
| D521,096 | S | 5/2006 | Pelz | |
| 7,090,599 | B2 | 8/2006 | Hedgepath | |
| 7,125,350 | B1 | 10/2006 | Reason-Kerkhoff | |
| 7,527,562 | B1 | 5/2009 | Mason | |
| D602,553 | S | 10/2009 | Wright | |
| D634,385 | S | 3/2011 | Parrish, Jr. | |
| 7,896,759 | B2 | 3/2011 | Jackson | |
| D657,433 | S | 4/2012 | Vidales | |
| 9,352,206 | B2 | 5/2016 | Uehling, III | |
| D805,811 | S | 12/2017 | Armitage | |
| D820,372 | S | 6/2018 | Johnson | |
| 10,112,093 | B2 | 10/2018 | Peebles | |
| 10,456,652 | B2 * | 10/2019 | Mack | A63B 69/3673 |
| D878,497 | S | 3/2020 | Miles | |
| D909,501 | S | 2/2021 | Knable | |
| D969,516 | S | 11/2022 | Mross | |
| 11,504,592 | B2 * | 11/2022 | Carullo | A63B 69/3661 |
| D989,209 | S | 6/2023 | Vasas | |
| 2003/0130072 | A1 | 7/2003 | Barth et al. | |
| 2005/0143200 | A1 * | 6/2005 | Hedgepath | A63B 69/0002 473/452 |
| 2006/0234816 | A1 | 10/2006 | Reason-Kerkhoff | |
| 2006/0258486 | A1 | 11/2006 | Hedgepath | |
| 2008/0132362 | A1 * | 6/2008 | Brazzano | A63B 69/0075 473/417 |
| 2011/0098136 | A1 | 4/2011 | Maresh | |
| 2013/0157785 | A1 | 6/2013 | Connors | |
| 2013/0337928 | A1 * | 12/2013 | Scott | A63B 69/3661 473/218 |
| 2014/0274484 | A1 | 9/2014 | Parvanov | |
| 2018/0050249 | A1 | 2/2018 | Peebles | |
| 2019/0022493 | A1 | 1/2019 | Peebles | |
| 2022/0370874 | A1 | 11/2022 | Ferrara | |

OTHER PUBLICATIONS web.archive.org [online], "The MILLERMAT—Zoned Store, " date daptured: Jan. 21, 2022, retrieved on Aug. 10, 2023, retrieved from URL<https://web.archive.org/web/20220121231616/https://zoned.store/products/the-millermat>, 5 pages.

* cited by examiner

BASEBALL BATTING MAT WITH FRONT FOOT RESTRAINT

RELATED APPLICATION

This application is a continuation application of, and claims priority to, U.S. patent application Ser. No. 17/207,731, for BASEBALL BATTING MAT WITH FRONT FOOT RESTRAINT, filed on Mar. 21, 2021 which claims the benefit of the filing date of 62/992,940, filed on Mar. 21, 2020. The disclosure of the foregoing applications are incorporated here by reference in their entirety.

BACKGROUND

This description relates to baseball training, and more particularly to a baseball batting mat with a front foot restraint.

Training players in baseball can involve how to properly position and move the lower body when swinging a baseball bat. In baseball, quality of ball striking is impacted by the player's general balance and stability before, during, and after the swing. The momentum caused by swinging a bat can induce players to lose balance at different points in the swing. To improve balance and stability, the feet must continuously maintain contact with the ground—especially the front foot. Young players are commonly challenged to keep the front foot in contact with the ground throughout the entire swing.

Often times, players position their feet poorly in their stance and when they swing. For example, their feet may move around erroneously, causing their head and eyes to also move. Energy is not transferred properly from the lower body to the upper body and a weak and inconsistent swing is the result.

When swinging, baseball or softball players often stride—or lift the front foot and move it forward—before swinging. The goal of the stride is to create momentum, which is transferred into the swing, to induce additional power. However, the stride inhibits a balanced swing because players can have difficulty, in concert, implementing the stride and swinging in a balanced manner. When the foot leaves the ground, it introduces a level of complexity to the swing because the foot must make ground contact—and balance must be achieved after foot strike—before the swing commences. This additional movement proves to inhibit learning in young players.

Both U.S. patent Ser. No. 10/112,093 and U.S. Pat. Publ. No. 20060258486 show baseball stance training mats that are intended to promote a proper baseball batting stance by indicating where a player should stand, relative to the home plate indicia along with indicating a width of the feet during the stance.

U.S. Pat. No. 20110098136 shows a baseball training mat that includes a rectangular panel, including a raised feature, that promotes proper foot placement. Its object is to guide proper movement of the feet while performing the baseball swing.

U.S. Pat. No. 6,386,996 shows a baseball swing stride analyzer and trainer that is comprised of a mat with a grid imprinted on it. The object of this device is to analyze the movement of the front foot when taking a stride to hit a baseball.

U.S. Pat. No. 6,955,616 shows a baseball batting training device that includes an apparatus for the front foot of a player. This apparatus allows the foot "to stride in any direction." This device is aimed at training the player's stride to ensure that the player strides forward. This reference contemplates an apparatus that is removable and worn by the player while not using the device. The player is able to lift his or her front foot and move it in any direction, thereby losing contact with the ground during the swing.

U.S. Pat. No. 6,432,001 shows a Foot Position Trainer apparatus targeted at the back foot of a baseball player. It is designed to accept the foot and to stick into the ground, restricting the players ability to lift the back foot during the swing.

U.S. Pat. No. 7,090,599 shows a baseball training mat that includes a break-away attachment on the rear foot of a baseball player.

U.S. Pat. No. 3,350,096A describes an apparatus that prevents the player from"throwing the front foot out of the batter['']s box and having no follow through power." This device is aimed at an action in which the players foot "strides forward" using a "movable foot piece."

SUMMARY

As described in this specification, a sports training apparatus includes a flat mat having visible indicia that are adapted to indicate placement of at least one foot of a user of the apparatus. A foot restraint is adapted to hold a front foot of the user so that the front foot remains in contact with a top surface of the flat mat. The front foot is in an intended direction of a swing of a sports implement. The visible indicia can include a line indicating a forward placement of toes of the user. The visible indicia can be adapted to indicate placement of a rear foot of the user without restraining the rear foot. The sports implement can be a baseball bat or a golf club. The foot restraint can be adapted to hold the front foot perpendicular to a direction of a pitch. Alternatively, the foot restraint can hold the front foot at an angle relative to perpendicular to a direction of a pitch such that the toes of the front foot are in a direction closer to the direction of the pitch than the heel of the front foot. The sports training apparatus can be adapted to be used by both a left-handed and a right-handed batter. The foot restraint can have an adjustable length to accommodate different sized feet.

The sports training apparatus can be used for training a baseball hitter to have balance before, during, and after the swing. The indicia can indicate proper foot positioning in a baseball batting stance. The foot restraint can be cuff or other tethering restraint connected to the mat (or looped through slats in the mat material) and fixed atop the ground surface. The cuff can be placed over the middle or front of the top of the user's front foot and used to loosely restrain the front foot of a batter, causing the foot to remain in contact with the mat before, during, and after the swing. The mat can include multiple indicia, which can be placed in a manner to account for varying levels of height of the particular user. The sports training apparatus can be used to loosely secure the front foot of a player to the mat during a swing that allows the player to insert and remove their foot only, and not stride or move the foot laterally, along a center line/toe alignment indicium, before, during, and after the swing. The foot restraint can be adjustable to the users' foot size using nylon, polypropylene, or other similar, flexible tethering material.

As used in this specification, the term "baseball" can refer to both the sports of baseball and softball, although the mat is also applicable to use in the sport of golf.

DETAILED DESCRIPTION

Figure 1:
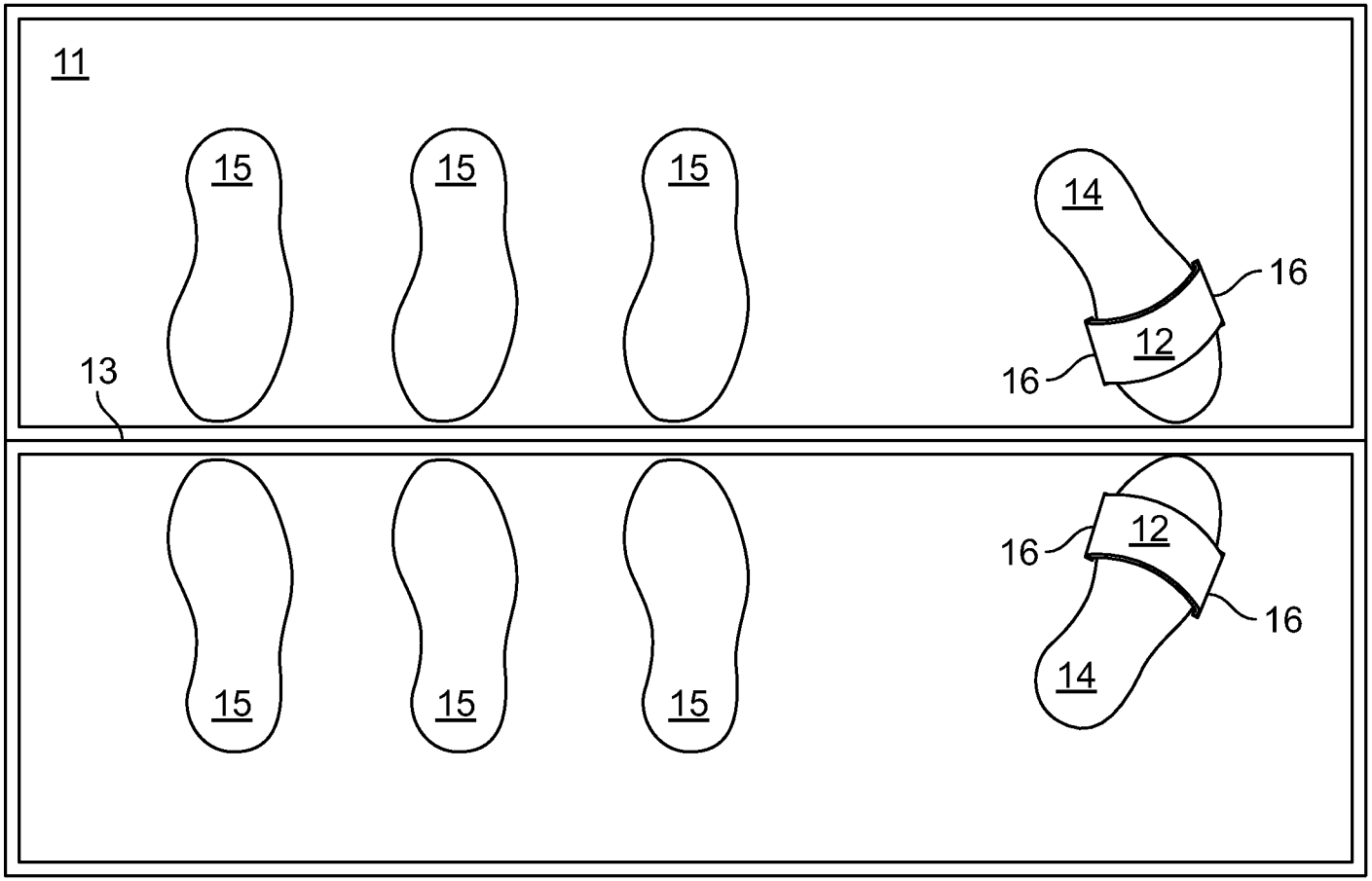
FIG. 1 is a perspective view of the mat from above, showing its indicia and location of the front foot restraint.

One successful coaching approach includes teaching a proper, balanced swing without striding (i.e. starting and finishing the swing with the feet in the same place, albeit with the back-foot rotated). Once the swing is mastered, a stride may be implemented. Coaches and instructors demonstrate this technique, and players must see the demonstration and then mimic it on their own. This mimicking is often difficult to do so without assistance. A tool that teaches players to keep consistent ground contact with their front foot, and to maintain stability of the lower body before, during, and after the swing can greatly enhance coaches' and instructors' ability to help their players understand the concepts of using the feet properly when executing a baseball swing. Further, a tool that promotes stability and balance by presenting the player's front foot with bias to achieve continual ground contact will more efficiently assist them in learning a powerful and consistent baseball swing.

Most baseball mats provide players with proper foot positioning, relative to the hitting area, yet they do not loosely restrain the front foot to promote stability of the lower body and balance before, during, and after the swing.

An improved training device uses a mat, an adjustable front foot cuff or restraint, and visible indicia that promote proper placement and use of the feet (and legs and back) to execute a powerful, efficient, and consistent baseball swing for ball striking. A good batting stance includes feet that are positioned in a perpendicular manner (or somewhat perpendicular) to the hitting area (or direction of the pitched ball). A center line/toe alignment indicium on the mat can promote the player lining up one's feet in this manner. Additional indicia promote the proper placement and rotation of the back foot during the swing—depending on the player's height. The mat does not constrain movement of the back foot. When executing a swing, the player is able to rotate his or her back foot in a manner that promotes proper rotation. This movement creates a powerful swing and enables the player to leverage the power of one's larger muscles of the hips, legs, and back to transfer energy into the arms, wrists, and hands for a powerful swing. If the back foot does not rotate, it does not enable a player to rotate the hips and legs properly, resulting in a poorly executed swing.

The mat uses economical and durable material to withstand both indoor and outdoor use in rugged (athletic) conditions. In some implementations, the mat may include both a right-handed and a left-handed side (e.g., facing one another). In alternative implementations, the mat may include only one side (and centerline/toe alignment indicium) for handedness. For example, a mat may be only used for a right-handed player, while another mat may be used only for a left-handed player. In other alternative implementations, a mat may have foot restraints on each end, one for use by right-handed players and the other for use by left-handed players, with indicia for placement of the back foot in between. In these implementations, the mat can be turned around such that the direction of a pitch is coming from whichever end is appropriate for a left-handed or right-handed player.

The training device can also include an indicium for placement of the front foot (with toes touching the center line/toe alignment indicium) and a foot-receiving, adjustable cuff, or other restraint apparatus, made of nylon (or other flexible material) to loosely tether the foot to the mat before, during, and after the swing. The cuff can be connected to the mat (or looped through slats in the mat). In some implementations, the apparatus may be connected to the mat to ensure the foot is perpendicular to the center line/toe alignment indicium. Alternative implementations may place the cuff at an angle to ensure the foot is placed in an open angle to the center line/toe alignment indicium (i.e. not perpendicular to the center line/toe alignment indicium). The foot restraint can surround (or cover) the middle of the front foot of the player. The foot restraint can fasten to the front foot to keep it in place, but preferably not in a manner that the foot cannot be inserted and removed with ease. The foot restraint may contain buttons or other fasteners on each end to connect the restraint to the mat. These fasteners may release if the foot is pulled away in a forceful manner (thereby prohibiting the player from tripping). The object of the restraint is to provide bias and promote the player keeping ground contact with the front foot while executing the swing. The foot cuff can be adjustable to the size of the player's foot.

The training device is intended to be used in short toss batting practice sessions, and not used when performing full hit and run batting practice sessions. The device decreases greatly the amount of time that it takes an instructor to teach the proper movements in a swing. Additional advantages will become apparent from a study of the following description and the accompanying diagrams.

FIG. 1 is a perspective view of the mat 11 viewed from above constructed in accordance with one implementation of the training device. The front foot restraint 12 is placed on both the right-handed and left-handed side of the center line/toe alignment indicium 13. Each foot restraint has a front foot indicium 14 for front foot placement. As shown in FIG. 1, both a right-handed and left-handed side are constructed on the same mat 11. In another embodiment, only one may be present (for example: a right-handed only mat). In addition, multiple back foot placement indicia 15 represent various potential placements of the back foot on the mat 11. In some implementations, these indicia may be of a foot print, while other implementations may use other markers as indicia. Some implementations include three back foot placement indicia 15, while other implementations may include fewer than three or more than three indicia. As shown in FIG. 1, the foot restraint can hold the front foot at an angle relative to perpendicular to a direction of a pitch (i.e., an open angle) such that the toes of the front foot are in a direction closer to the direction of the pitch than the heel of the front foot.

Figure 2:
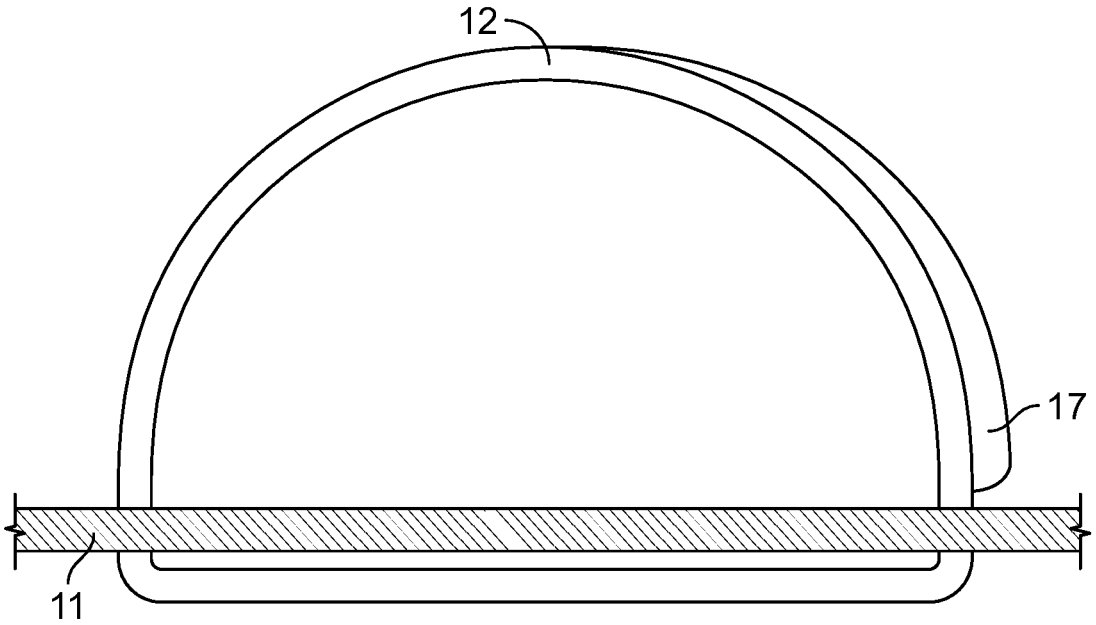
FIG. 2 is a lateral cross-sectional view of the front foot restraint.

FIG. 2 is a lateral cross-sectional view of the front foot restraint 12. The foot restraint may be constructed of nylon, neoprene, rubber, or some other flexible material. FIG. 2 shows one embodiment in which the foot restraint loops through holes, or slits 16, in the mat 11. Other embodiments may include buttons or other fasteners to connect the restraint to the mat. The front foot restraint 12 includes an adjustable length mechanism 17, such as a hook and loop fastener so that the front foot restraint 12 can accommodate varying foot sizes for younger and older users. For example, the front foot restraint 12 can loop through slits 16 in the mat and be pulled tighter or made looser and then attached to itself using a hook and loop fastener.

Figure 3:
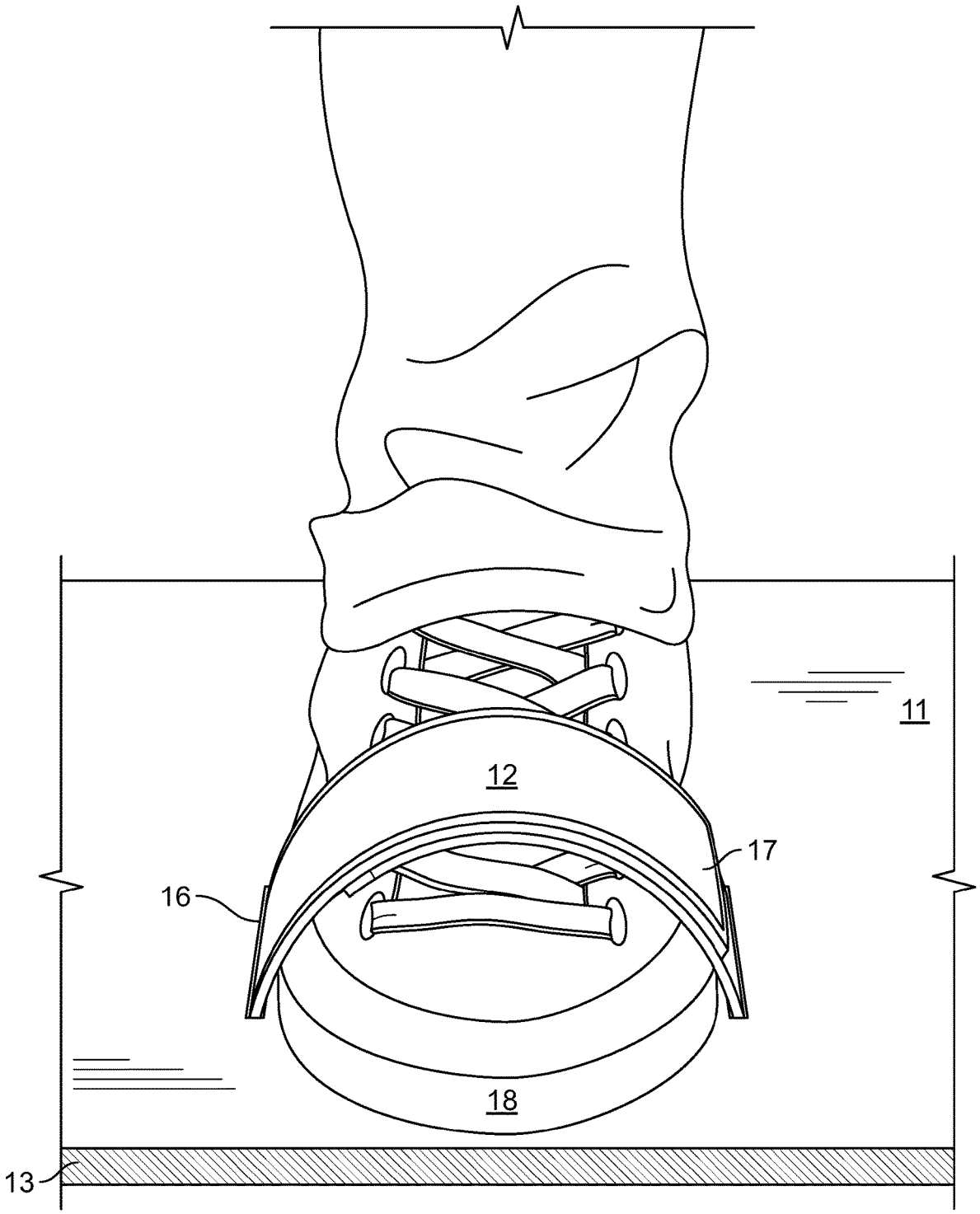
FIG. 3 is a perspective view of the front foot restraint, including a center line/toe alignment indicium.

FIG. 3 is a perspective view of the front foot restraint 12. The front foot restraint 12 can be constructed of a flexible material and can be designed to be fastened loosely to the user's front foot 18. As described above, the front foot restraint can loop through the slits 16 in the mat. In other embodiments, the front foot restraint 12 may be fastened directly to the mat 11 using buttons or other fasteners ensuring a snug fit next to the user's front foot 18. The object of the front foot restraint 12 is to restrict lateral movement of the foot (along the center line/toe alignment indicium or line 13). The front foot restraint 12 is constructed to ensure constant contact between the user's front foot 18 and the mat 11 before, during, and after a swing. The front foot restraint 12 allows the user to easily remove the user's front foot 18 by moving it backward. FIG. 3 depicts a front foot restraint 12 holding the front foot perpendicular to the line 13 and to an intended direction of a pitch.

Figure 4:
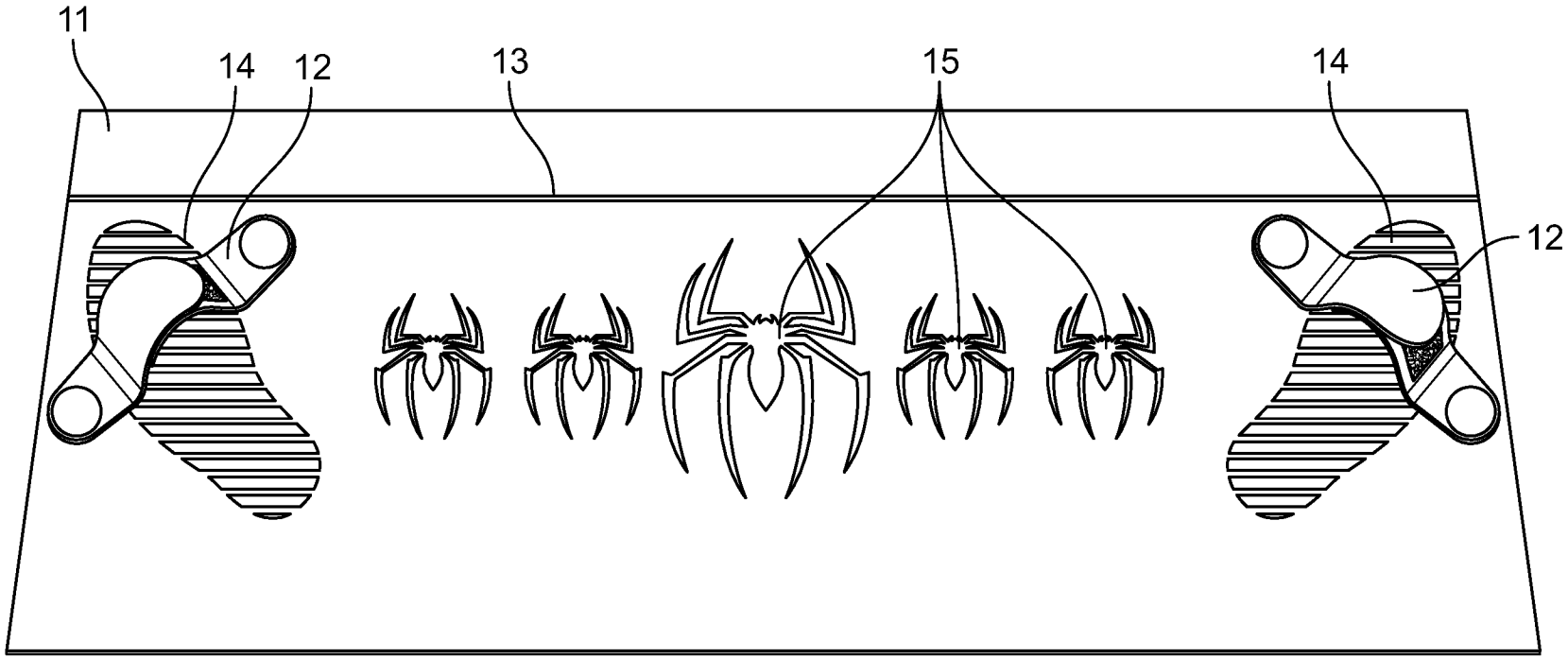
FIG. 4 depicts an alternative implementation of the mat viewed from above.

FIG. 4 depicts an alternative implementation of the mat 11 viewed from above. The implementation depicted in FIG. 4 includes two front foot restraints. The front foot restraint 12 on the left side can be used for right-handed batters, while the front foot restraint 12 on the right side can be used for left-handed batters. In this implementation, the back foot placement indicia 15 are represented as spiders.

Figure 5:
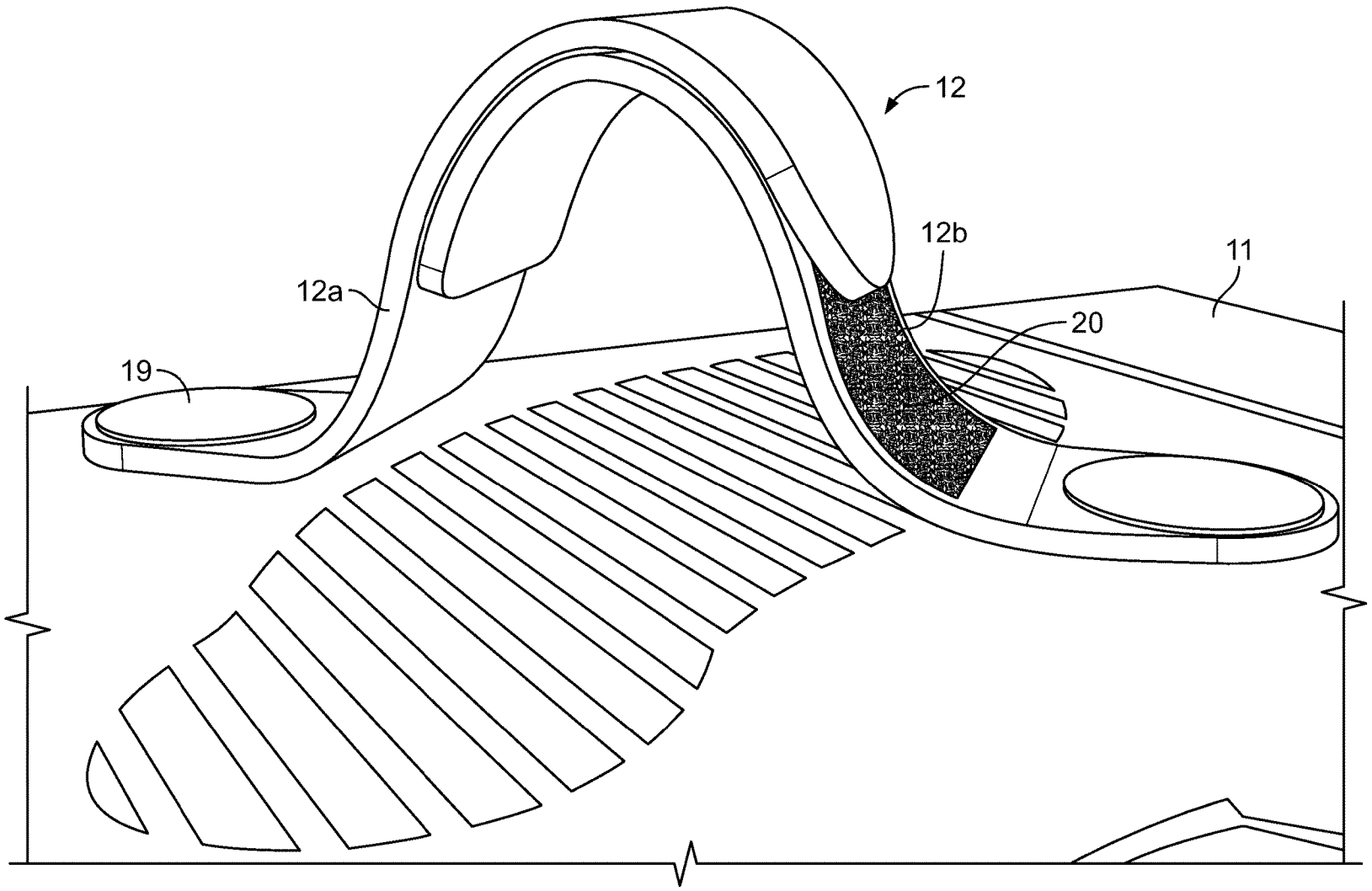
FIG. 5 depicts a close-up view of the foot restraint shown in FIG. 4.

FIG. 5 depicts a close-up view of the foot restraint 12 shown in FIG. 4. The foot restraint 12 is attached to the mat at 19 (e.g., using an adhesive and/or a button-type connector). The foot restraint 12 includes a first half 12*a* and a second half 12*b* that can be detached from one another to adjust a length of the foot restraint 12 and reconnected using a hook and loop fastener 20 to accommodate different foot sizes. As shown in FIG. 5, the back foot placement indicia 15 can include a visual cue or reminder to allow the back foot to rotate during the swing follow-through. For young players, this is often described as "squashing a bug" (i.e., allowing the foot to rotate) when learning to bat. The use of a spider can thus serve as a reminder to allow the back foot to rotate.

Figure 6:
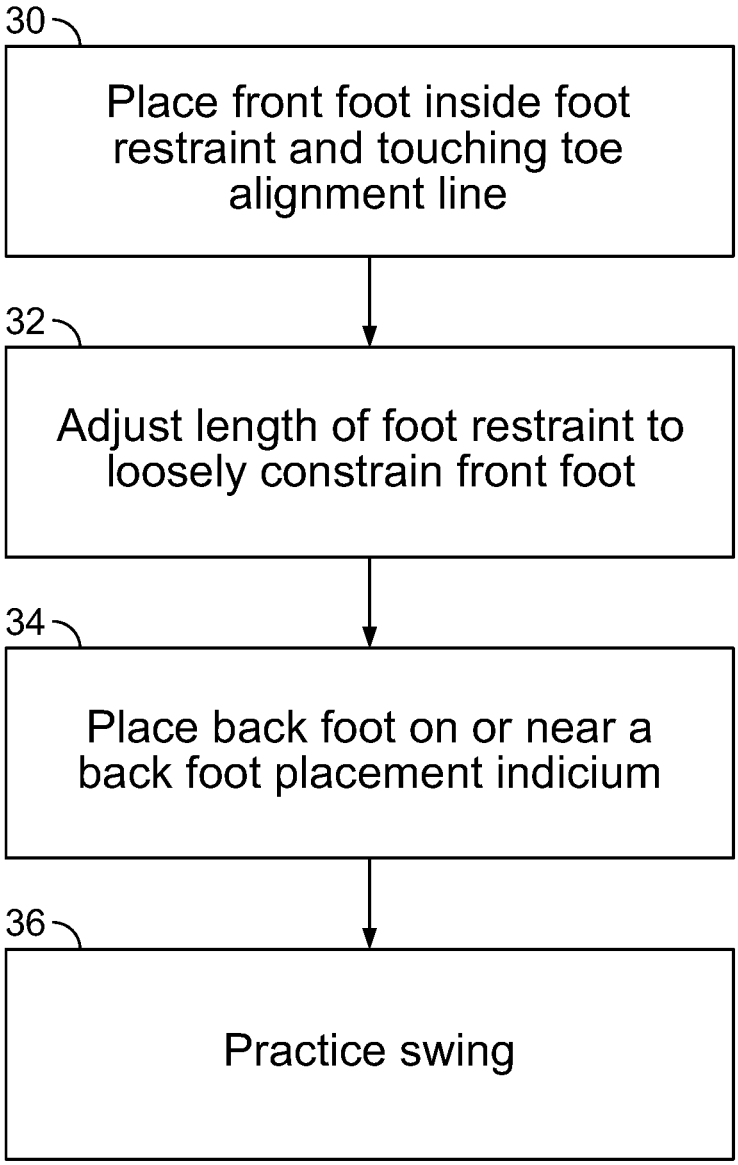
FIG. 6 is a flowchart showing a method of using a training device.

FIG. 6 is a flowchart showing a method of using a training device as described above. In operation, a user uses the mat 11 during short-toss batting practice. For safety purposes, it is not recommended to use the device during full hit and run batting practice. The user places his or her foot on the front foot indicium 14 with toes touching the center line/toe alignment indicium 13 and inside the front foot restraint 12 (at 30). An adjustable apparatus 17 on or about the front foot restraint 12 is adjusted (at 32) and the front foot restraint 12 is loosely affixed to the front foot (e.g., to loosely constrain the front foot). The tension of the adjustable apparatus 17 on or about the front foot restraint 12 should be loose enough to enable easy removal of the foot (by moving the foot backward). The intent of the foot restraint is to provide bias to the user to keep his or her foot in contact with the mat 11 before, during, and after the swing. The front foot restraint restrains the foot, however, such that the user is not able to move his or her foot laterally along the center line/toe alignment indicium 13.

The back foot is placed on or near one of the back-foot placement indicia 15 based on the user's height (at 34). The indicium closest to the front foot restraint 12, for example, would be for a shorter user, while the indicium farthest from the front foot restraint 12, for example would be for a taller user. The back foot is placed in a manner in which the toes of the back foot are placed on or against the center line/toe alignment indicium 13. The user then practices a swing (at 36) either in response to a pitch or as a practice swing. During the swing, the back foot is free to rotate, while the front foot remains stationary.

When used properly, the following effects occur. The stance of the user is such that the feet are aligned along the center line/toe alignment indicium 13. This position ensures perpendicular alignment of the user's body to the hitting area. The front foot of the user remains stationary before, during, and after the swing thereby stabilizing the lower extremities of the batter and promoting balance. A stable lower body increases the consistency and the power of the swing. The back foot of the user is able to rotate freely—creating a proper swing—and transfers power from the lower half of the body to the upper part of the body, producing a powerful swing. After the swing, the batter's foot remains contacting the ground—inside the foot restraint 12 and on the front foot indicium 14. The back foot has rotated and remains in contact with the back-foot indicium that it began on. A balanced and stabilized swing may have been executed.

While this specification contains many implementation details, these should not be construed as limitations on the scope of the invention or of what may be claimed, but rather as descriptions of features specific to particular implementations of the invention. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Thus, particular implementations of the invention have been described.

Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed is:

1. A sports training apparatus, comprising:

a mat including visible indicia adapted to indicate placement of at least one foot of a user of the sports training apparatus, with the mat adapted for placement of both feet of the user on a top surface of the mat;

foot restraints configured to be coupled to the mat such that when the foot restraints are coupled to the mat they are spaced apart from each other such that one of the foot restraints is positioned closer to one end of the mat and the other of the foot restraints is positioned closer to another end of the mat, the foot restraints adapted to hold a front foot of the user so that the front foot remains in contact with the top surface of the mat, wherein the front foot is in an intended direction of a swing of a sports implement, and the front foot of the user is a user's left foot for a right-handed user and a user's right foot for a left-handed user; and a plurality of visual indicators located on the top surface of the mat and between the foot restraints when the foot restraints are coupled to the mat, the plurality of visual indicators identifying locations on the top surface of the mat for placement of a rear foot of the user without restraining the rear foot, and the plurality of visual indicators including a graphic representation providing a reminder to the user to rotate the rear foot as part of the swing.

2. The sports training apparatus of claim 1, wherein the visible indicia include a line indicating a forward placement of toes of the user.

3. The sports training apparatus of claim 1, wherein the sports implement is a baseball bat.

4. The sports training apparatus of claim 1, wherein the foot restraints are adapted to hold the front foot perpendicular to a direction of a pitch.

5. The sports training apparatus of claim 1, wherein the foot restraints are adapted to hold the front foot in contact with the mat and at an angle relative to perpendicular to a direction of a pitch such that toes of the front foot are in a direction closer to the direction of the pitch than a heel of the front foot.

6. The sports training apparatus of claim 1, wherein the sports implement is a golf club.

7. The sports training apparatus of claim 1, wherein the sports training apparatus is adapted to be used by both a left-handed and a right-handed batter.

8. The sports training apparatus of claim 1, wherein the foot restraints have an adjustable length to accommodate different sized feet.

9. The sports training apparatus of claim 1, wherein the foot restraints comprise a cuff configured to be coupled to the mat and adapted to be placed over a top of a user's front foot and to loosely restrain the front foot.

10. A method of using the sports training apparatus of claim 1, comprising:

coupling one of the foot restraints into position on the mat;

placing a front foot of a user in a foot restraint of the foot restraints;

placing a back foot of the user on one of the plurality of visual indicators on the top surface of the mat; and performing a swing by the user.

11. The method of claim 10, further comprising adjusting a length of the foot restraint to lightly restrain the user's foot.

12. The method of claim 10, wherein placing the back foot of the user on one of the plurality of visual indicators on the top surface of the mat comprises placing the back foot of the user on one of the plurality of visual indicators on the top surface of the mat according to a height of the user, wherein a first indicator of the plurality of visual indicators closest to the foot restraint is used for a user of a first height and a second indicator of the plurality of visual indicators farthest from the foot restraint is used for a user of a second height, wherein the first height is less than the second height.

13. The sports training apparatus of claim 1, wherein the foot restraints are adapted to prevent the front foot from rotating.

14. The sports training apparatus of claim 1, wherein the foot restraints are adapted to hold the front foot in contact with the mat and at an angle relative to perpendicular and parallel to an edge of the mat.

15. The sports training apparatus of claim 1, wherein the foot restraints are adapted to hold the front foot in contact with the mat and to provide bias to the user to maintain contact of the front foot with the mat before the swing, during the swing, and after the swing.

16. The sports training apparatus of claim 1, wherein the foot restraints are adapted to prevent the front foot from moving laterally before the swing, during the swing, and after the swing.

17. The sports training apparatus of claim 1, wherein the foot restraints are configured to be coupled to the mat using at least one of an adhesive or a button-type connector.

18. The sports training apparatus of claim 1, where the foot restraints and the plurality of visual indicators enable the front foot to remain stationary as part of the swing and the rear foot is free to rotate as part of the swing.

19. The sports training apparatus of claim 1, wherein the visible indicia include a marker representative of a footprint.

20. The sports training apparatus of claim 1, wherein the visible indicia can reflect proper positioning of a foot in a baseball batting stance.

* * * * *